US011920423B2

(12) United States Patent
Murphy

(10) Patent No.: US 11,920,423 B2
(45) Date of Patent: Mar. 5, 2024

(54) TUBING HANGER ASSEMBLY WITH ADJUSTABLE LOAD NUT

(71) Applicant: FMC Technologies, Inc., Houston, TX (US)

(72) Inventor: Richard M. Murphy, Houston, TX (US)

( * ) Notice: Subject to any disclaimer, the term of this patent is extended or adjusted under 35 U.S.C. 154(b) by 0 days.

(21) Appl. No.: 18/102,035

(22) Filed: Jan. 26, 2023

(65) Prior Publication Data

US 2023/0184048 A1 Jun. 15, 2023

Related U.S. Application Data

(63) Continuation of application No. 17/506,537, filed on Oct. 20, 2021, now Pat. No. 11,578,553, which is a continuation of application No. 16/755,576, filed as application No. PCT/US2017/060461 on Nov. 7, 2017, now Pat. No. 11,180,969.

(51) Int. Cl.
*E21B 33/04* (2006.01)
*E21B 33/043* (2006.01)

(52) U.S. Cl.
CPC ..... *E21B 33/0415* (2013.01); *E21B 33/043* (2013.01)

(58) Field of Classification Search
CPC ..... E21B 33/0415; E21B 33/043
See application file for complete search history.

(56) References Cited

U.S. PATENT DOCUMENTS

| | | | | |
|---|---|---|---|---|
| 4,019,580 | A * | 4/1977 | Garrett | E21B 33/043 166/212 |
| 4,561,499 | A * | 12/1985 | Berner, Jr. | E21B 33/043 166/341 |
| 5,158,326 | A * | 10/1992 | Anderson | F16L 17/10 285/123.9 |
| 6,520,263 | B2 * | 2/2003 | June | E21B 33/043 166/88.1 |
| 10,323,484 | B2 * | 6/2019 | Liess | E21B 19/20 |
| 11,180,969 | B2 * | 11/2021 | Murphy | E21B 33/0415 |
| 11,236,572 | B2 * | 2/2022 | McAllister | E21B 33/03 |
| 11,332,995 | B2 * | 5/2022 | Murphy | E21B 33/043 |
| 2011/0169224 | A1 * | 7/2011 | Nguyen | E21B 17/04 277/336 |
| 2012/0241162 | A1 * | 9/2012 | Yates | E21B 33/043 166/348 |
| 2013/0248196 | A1 * | 9/2013 | Gette | E21B 33/03 166/348 |
| 2016/0265298 | A1 * | 9/2016 | Nguyen | E21B 33/04 |
| 2018/0209223 | A1 * | 7/2018 | Ojong | E21B 33/146 |

* cited by examiner

*Primary Examiner* — Aaron L Lembo
(74) *Attorney, Agent, or Firm* — Henry C. Query, Jr.

(57) ABSTRACT

A tubing hanger assembly includes a tubing hanger body, a downward facing load shoulder axially displaceable relative to the body, an annular load member rotatably supported on the body, and a torque member operatively engaged between the load member. The load shoulder and load member are arranged such that rotation of the load member relative to the body results in axial displacement of the load shoulder relative to the body. In use, the torque member rotates the load member to thereby displace the load shoulder axially relative to the body.

30 Claims, 6 Drawing Sheets

TUBING HANGER ASSEMBLY WITH ADJUSTABLE LOAD NUT

The present application is a continuation of U.S. patent application Ser. No. 17/506,537 filed on Oct. 20, 2021, which is a continuation of U.S. patent application Ser. No. 16/755,576 filed on Apr. 11, 2020, which is based on and claims priority from International Patent Application No. PCT/US2017/060461 filed on Nov. 7, 2017.

FIELD OF THE DISCLOSURE

The present disclosure is directed to a subsea hydrocarbon production system which includes a tubing hanger that is installed in a wellhead or the like. More particularly, the disclosure is directed to a coil spring arrangement which functions to automatically adjust the vertical position of the tubing hanger load shoulder so that the vertical distance between the load shoulder and the tubing hanger lockdown mechanism is the same as the vertical distance between the seat on which the load shoulder is landed and the wellhead locking profile which the lockdown mechanism is configured to engage.

BACKGROUND OF THE DISCLOSURE

Subsea hydrocarbon production systems typically include a wellhead which is positioned at the upper end of a well bore. The wellhead comprises a central bore within which a number of casing hangers are landed. Each casing hanger is connected to the top of a corresponding one of a number of concentric, successively smaller casing strings which extend into the well bore, with the uppermost casing hanger being connected to the innermost casing string. After the innermost casing string is installed, a tubing string is run into the well bore. The top of the tubing string is connected to a tubing hanger having a downward facing circumferential load shoulder which lands on a seat formed at the top of the uppermost casing hanger. In certain tubing hangers, the load shoulder is formed on a load nut which is threadedly connected to the tubing hanger body.

The tubing hanger is usually secured to the wellhead using a lockdown mechanism, such as a lock ring or a number of locking dogs, both of which comprise a number of axially spaced, circumferential locking ridges. The locking dogs are supported on the tubing hanger body and are expandable radially outwardly into a locking profile formed in the bore of the wellhead, such as a number of axially spaced, circumferential locking grooves, each of which is configured to receive a corresponding locking ridge. In order to ensure that the tubing hanger is properly locked to the wellhead, the vertical distance between the load shoulder and the locking dogs must be the same as the vertical distance between the seat and the locking profile, which is commonly referred to as the wellhead space-out. In this regard, the term "the same as" should be interpreted to mean that the vertical distance between the seat and the locking profile is such that the locking ridges can fully engage their corresponding locking grooves.

In tubing hangers in which the load shoulder is formed on a load nut that is threadedly connected to the tubing hanger body, the vertical distance between the load shoulder and the locking dogs can be adjusted by rotating the load nut relative to the tubing hanger body. Thus, once the wellhead space-out is determined, the load nut can be rotated until the vertical distance between the load shoulder and the locking dogs is the same as the wellhead space-out.

In the prior art, a lead impression tool (LIT) is sometimes used to measure the wellhead space-out. In subsea wellheads, the LIT is lowered on a drill string and landed on the seat. The LIT is then hydraulically actuated to press typically three circumferentially spaced lead impression pads into the locking profile. After the impressions are taken, the LIT is retrieved to the surface and mounted on a storage/test stand, which is then manually adjusted to match the lead impression tool. The tubing hanger is then mounted on the storage/test stand and the load nut is adjusted until the vertical distance between the load shoulder and the locking dogs is the same as the wellhead space-out.

Although the LIT provides a useful means for determining the wellhead space-out, the time required to run and retrieve the LIT can be relatively long, especially in deep water. Also, setting the tubing hanger on the storage/test stand and adjusting the load nut can be a time consuming process and is dependent on human interpretation.

SUMMARY OF THE DISCLOSURE

In accordance with one embodiment of the present disclosure, a tubing hanger assembly is provided that comprises a body which has an annular outer surface; a lockdown feature which is located on the body; a load nut which is threadedly connected to the body, the load nut comprising a downward facing load shoulder; and a torsion spring member which includes a first end that is connected to the tubing hanger and a second end that is connected to the load nut. In operation the torsion spring member rotates the load nut to thereby move the load nut axially relative to the body. In this manner, an axial distance between the load shoulder and the lockdown feature is adjustable.

In accordance with one aspect of the disclosure, the tubing hanger assembly further comprises means for selectively preventing the load nut from rotating relative to the body. For example, the means for selectively preventing the load nut from rotating relative to the body may include a latching mechanism which is positioned on one of the tubing hanger body and the load nut. In this example, the latching mechanism may comprise a latch member which is biased into engagement with a corresponding groove formed on the other of the tubing hanger body and the load nut.

In accordance with another aspect of the disclosure, the means for selectively preventing the load nut from rotating relative to the body further comprises a de-latching mechanism which is positioned on the other of the tubing hanger body and the load nut. For example, the de-latching mechanism may comprise a rod which includes a first end that is located proximate a bottom of the groove and a second end that extends a distance past the load shoulder, such that application of an axial force to the second end will cause the first end to displace the latch member from the groove.

In accordance with a further aspect of the disclosure, the latching mechanism is positioned on the tubing hanger body and the de-latching mechanism is positioned on the load nut. In this embodiment, the de-latching mechanism may comprise a rod which includes a first end that is located proximate a bottom of the groove and a second end that extends a distance past the load shoulder, such that application of an axial force to the second end will cause the first end to displace the latch member from the groove.

In accordance with yet another aspect of the disclosure, the tubing hanger assembly is configured to be installed in a wellhead which comprises a central bore in which a casing hanger is positioned, the load shoulder being configured to land on a seat which is formed on the casing hanger to thereby support the tubing hanger in the wellhead. In this embodiment, the central bore may comprise a locking profile and the lockdown feature may comprise a number of locking dogs which are supported on the body and are expandable into the locking profile to thereby secure the tubing hanger assembly to the wellhead. Further, during installation of the tubing hanger assembly, the torsion spring member may rotate the load nut until a distance between the load shoulder and the locking dogs is the same as a distance between the seat and the locking profile. Alternatively, the torsion spring member may rotate the load nut until a distance between the load shoulder and the locking dogs is the same as a distance between the seat and the locking profile after the locking dogs have been preloaded against the locking profile.

The present disclosure is also directed to method for installing a tubing hanger in a wellhead. The wellhead comprises a first tubing hanger lockdown feature and a central bore in which a casing hanger is positioned, and the tubing hanger comprises a second tubing hanger lockdown feature which is configured to engage the first tubing hanger lockdown feature, an annular body, and a load nut which is threadedly connected to the body and which includes a downward facing load shoulder which is configured to land on a seat that is formed on the casing hanger. The method comprises the steps of lowering the tubing hanger into the wellhead and then adjusting the axial position of the load nut until an axial distance between the load shoulder and the second tubing hanger lockdown feature is the same as a second axial distance between the seat and the first tubing hanger lockdown feature. In this embodiment, the step of adjusting the axial position of the load nut is performed by releasing a torsion spring member which is operatively engaged between the body and the load nut. Thus, the torsion spring member rotates the load nut and causes the load nut to move axially downward relative to the body.

In accordance with one aspect of the disclosure, the method further comprises the step of engaging the first and second tubing hanger lockdown features to thereby secure the tubing hanger to the wellhead.

In accordance with another aspect of the disclosure, the step of engaging the first and second tubing hanger lockdown features is performed before the step of adjusting the axial position of the load nut.

In accordance with yet another aspect of the disclosure, the step of adjusting the axial position of the load nut is performed after the first and second tubing hanger lockdown features have been preloaded against each other.

Thus, in one illustrative embodiment of the disclosure, the tubing hanger and adjustable load nut assembly enables the vertical spacing between the load shoulder and the locking dogs to be adjusted in real time as the tubing hanger is landed and locked in the wellhead. As a result, the need to measure the wellhead space-out and adjust the position of the load nut before the tubing hanger is run into the wellhead is eliminated, which greatly reduces the time required to install the tubing hanger.

These and other objects and advantages of the present disclosure will be made apparent from the following detailed description, with reference to the accompanying drawings. In the drawings, the same reference numbers may be used to denote similar components in the various embodiments.

DETAILED DESCRIPTION

Figure 1:
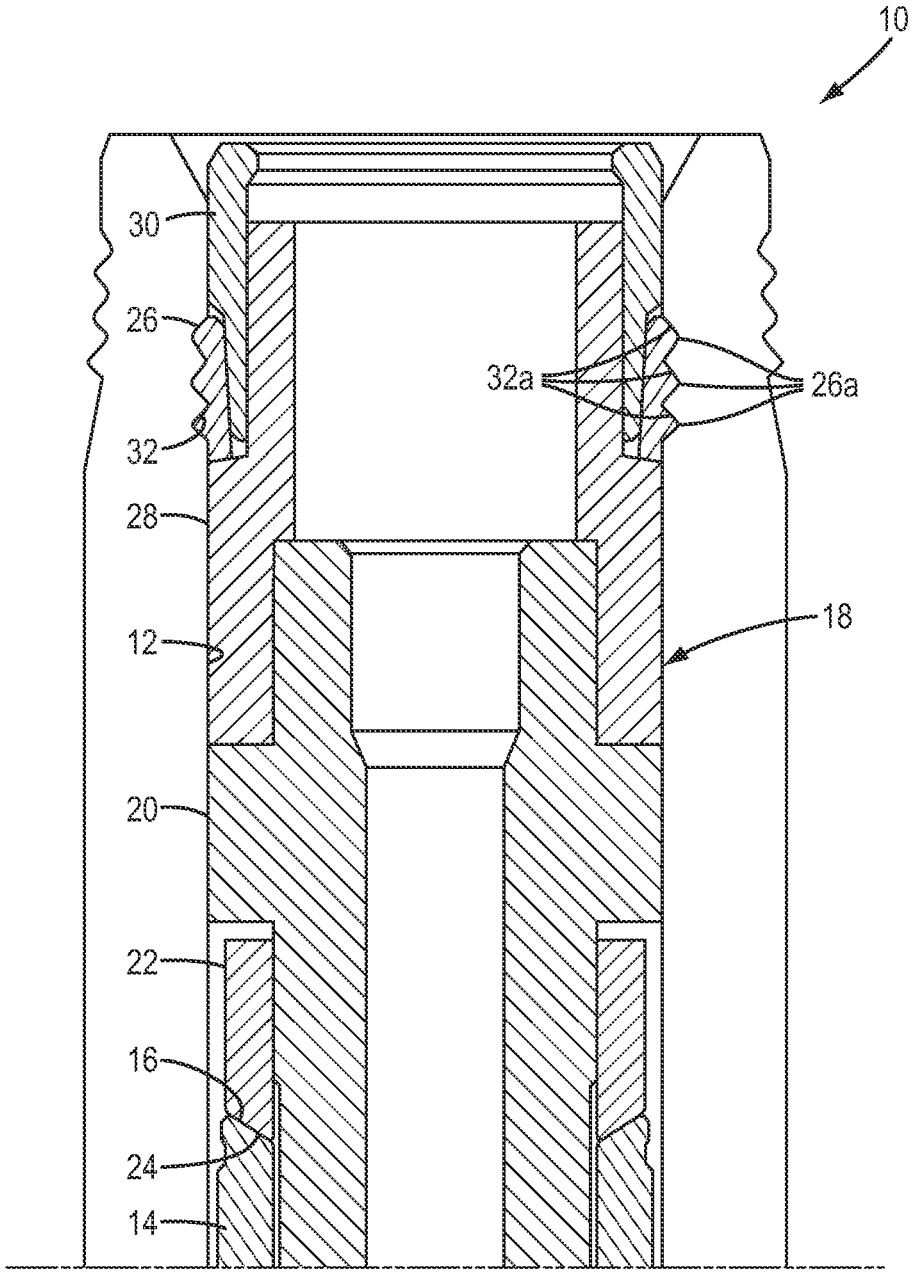
FIG. 1 is a cross sectional view of an example of a prior art wellhead system.

An example of a prior art wellhead system is shown in FIG. 1. The wellhead system includes a wellhead 10 (only the upper portion of which is shown) which is positioned at the top of a well bore (not shown). The wellhead 10 comprises a central bore 12 within which a number of casing hangers are landed, including an uppermost casing hanger 14 (only the upper portion of which is shown). The top of the casing hanger 14 is configured as a seat 16 on which a tubing hanger 18 is landed. The tubing hanger 18 includes a cylindrical body 20 and a load nut 22 which is threadedly connected to the body. The load nut 22 comprises a load shoulder 24 which engages the seat 16 when the tubing hanger 18 is landed in the wellhead 10.

The tubing hanger 18 is secured to the wellhead 10 using a suitable lockdown mechanism. In the example shown in FIG. 1, the lockdown mechanism includes a lock ring or a number of expandable locking dogs 26 which are supported on a lockdown ring 28 that is connected to the tubing hanger body 20. After the tubing hanger 18 is landed in the wellhead 10, a locking mandrel 30 is actuated to drive the locking dogs 26 into a locking profile 32 which is formed in the central bore 12. This action forces a number of axially spaced, circumferential locking ridges 26*a* formed on the locking dogs 26 into a corresponding number of axially spaced, circumferential locking ridges 32*a* formed in the locking profile 32 to thereby secure the tubing hanger to the wellhead.

As discussed above, in order to ensure that the tubing hanger 18 is properly locked to the wellhead 10, the vertical distance between the load shoulder 24 and the locking dogs 26 must be the same as the vertical distance between the seat 16 and the locking profile 32 (i.e., the wellhead space-out). The wellhead space-out may be determined using, e.g., a lead impression tool (LIT). In the wellhead system shown in FIG. 1, for example, the LIT would be lowered on a drill string and landed on the seat 16. The LIT would then be actuated to press a number of circumferentially spaced lead impression pads into the locking profile 32. After the impressions are taken, the LIT would be retrieved to the surface and mounted on a storage/test stand, which would then be manually adjusted to match the LIT. After this step, the tubing hanger 18 would be mounted on the storage/test stand and the load nut 22 would be manually rotated until the vertical distance between the load shoulder 24 and the locking dogs 26 is the same as the vertical distance between the seat and the locking profile. As may be apparent, this method for determining the wellhead space-out and adjusting the load nut until the vertical distance between the load shoulder and the locking dogs is the same as the wellhead space-out is a relatively time consuming process.

In accordance with the present disclosure, a tubing hanger and adjustable load nut assembly is provided which enables the vertical spacing between the load shoulder and the locking dogs to be adjusted automatically. As a result, the need to measure the wellhead space-out and adjust the position of the load nut before the tubing hanger is run into the wellhead is eliminated, which greatly reduces the time required to install the tubing hanger.

Figure 2:
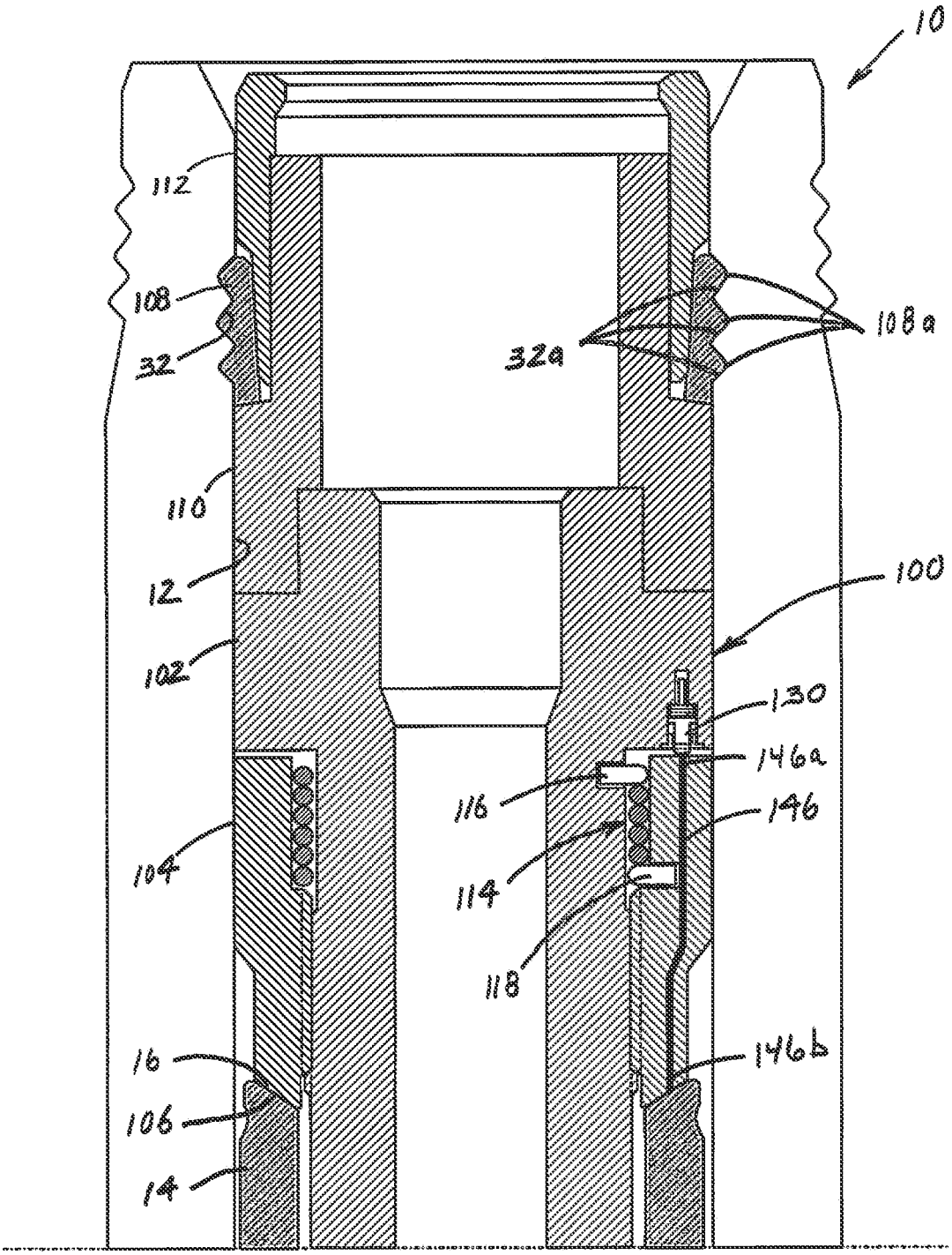
FIG. 2 is a cross sectional representation of an embodiment of the tubing hanger and adjustable load nut assembly of the present disclosure shown immediately after the tubing hanger has been landed in a wellhead and the tubing hanger lockdown mechanism has been engaged.

An illustrative embodiment of a tubing hanger and adjustable load nut assembly of the present disclosure is shown in FIG. 2. In FIG. 2, the tubing hanger, which is indicated generally by reference number 100, is shown landed and locked, but not yet pre-tensioned, in a representative wellhead 10. Similar to the example described above in connection with FIG. 1, the wellhead 10 comprises a central bore 12 within which a number of casing hangers are landed, including an uppermost casing hanger 14 (only the upper portion of which is shown). In this example, the top of the casing hanger 14 is configured as an upward facing seat 16 on which the tubing hanger 100 is landed.

Figure 5:
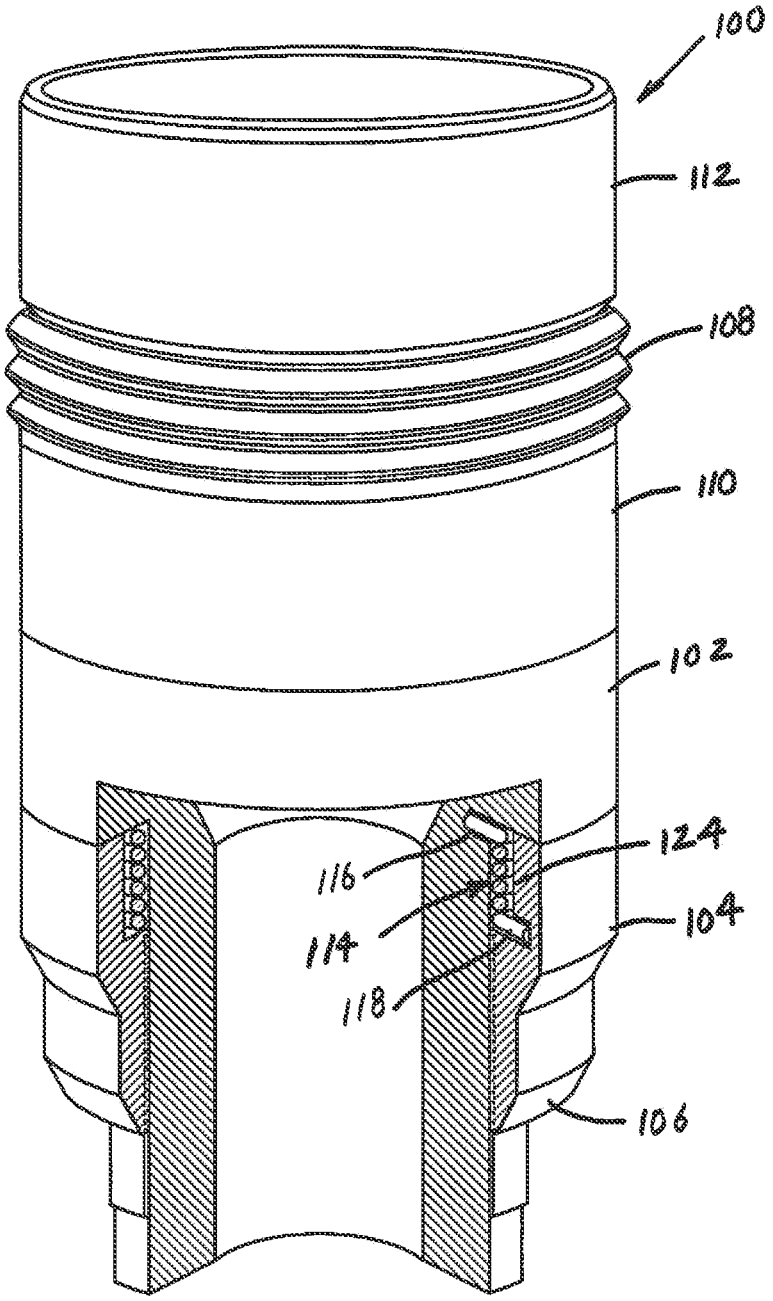
FIG. 5 is a perspective, partially cutaway view of an embodiment of the tubing hanger and adjustable load nut assembly of the present disclosure showing the load nut in its initial or upper position.

Referring also to FIG. 5, the tubing hanger 100 includes an axially extending body 102 comprising an annular outer surface. A load nut 104 is threadedly connected to the body 102 and includes a downward facing load shoulder 106 which engages the seat 16 when the tubing hanger 100 is landed in the wellhead 10. Due to the threaded connection between the load nut 104 and the body 102, rotation of the load nut relative to the body will result in axial displacement of the load nut relative to the body.

The tubing hanger 100 is secured to the wellhead 10 by engagement of interacting lockdown features on the tubing hanger and the wellhead. The lockdown features may comprise any suitable means for securing the tubing hanger to the wellhead. For example, the wellhead may comprise a locking profile in the central bore which is engaged by a lock ring carried on the tubing hanger or on a separate lockdown mandrel or similar device. As another example, the tubing hanger may comprise a locking profile on the outer surface which is engaged by a number of locking pins or similar devices mounted on the wellhead.

In the example shown in FIG. 2, the tubing hanger lockdown feature comprises a number of expandable locking dogs 108 which are supported on a lockdown ring 110 that is connected to the tubing hanger body. Alternatively, the locking dogs may be supported directly on the tubing hanger body 102. Also, the wellhead lockdown feature comprises a locking profile 32 which is formed in the central bore 12. As with the locking dogs 26 described above, the locking dogs 108 in this example embodiment comprise a number of axially spaced, circumferential locking ridges 108*a* which are configured to be received in the axially spaced, circumferential locking grooves 32*a* of the locking profile 32. In this example, after the tubing hanger 100 is landed in the wellhead 10, a locking mandrel 112 is actuated to drive the locking ridges 108*a* into the locking grooves 32*a* to thereby secure the tubing hanger to the wellhead.

As discussed above, in order to ensure that the tubing hanger 100 is properly locked to the wellhead 10, the vertical distance between the load shoulder 106 and the locking dogs 108 must be the same as the vertical distance between the seat 16 and the locking profile 32. In the prior art, the vertical distance between the load shoulder 106 and the locking dogs 108 was adjusted manually. In accordance with the present disclosure, after the tubing hanger 100 is landed and locked in the wellhead 10, and preferably also pre-tensioned from above, the vertical distance between the load shoulder 106 and the locking dogs 108 is adjusted automatically using a novel torsion spring arrangement.

Figure 4:
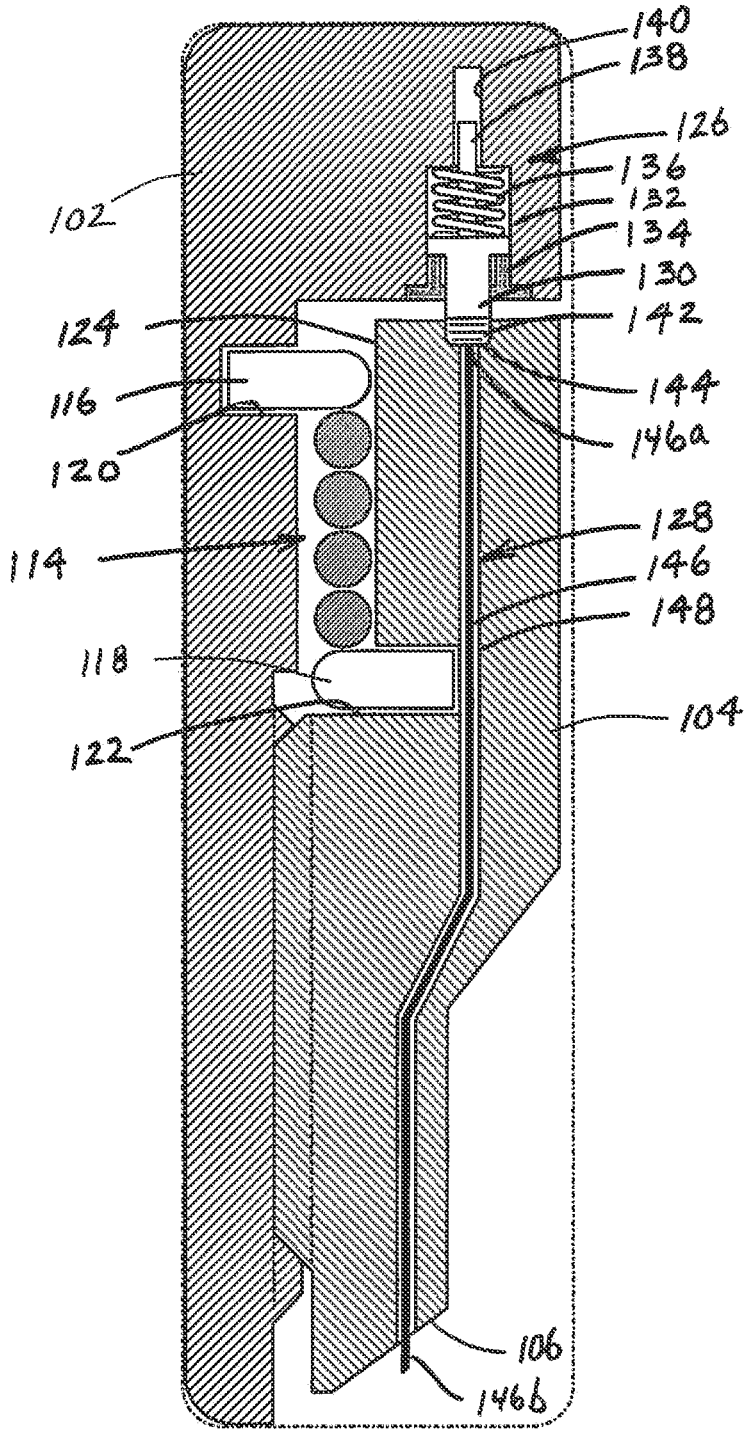
FIG. 4 is an enlarged cross sectional view of an illustrative embodiment of the load nut latching mechanism of the present disclosure.

Referring also to FIG. 4, the torsion spring arrangement includes a torsion spring 114 which is operatively engaged between the tubing hanger body 102 and the load nut 104. The torsion spring 114 is a helically wound member which comprises a radially inwardly extending first end 116 that is secured to the tubing hanger body 102 and a radially outwardly extending second end 118 that is secured to the load nut 104. In the illustrative embodiment of the invention shown in the drawings, the first end 116 may be received in a corresponding first hole 120 which is formed in the tubing hanger body 102 and the second end 118 may be received in a corresponding second hole 122 which is formed in the load nut 104. In addition, the torsion spring 114 may be positioned in a circumferential recess 124 which is formed in the inner diameter surface of the load nut 104 (but may alternatively be formed in the outer diameter surface of the tubing hanger body 102).

During assembly of the tubing hanger 100, the load nut 104 is threaded onto the tubing hanger body 102 until it reaches an initial or upper position, which is shown in FIGS. 4 and 5. As the load nut 104 is threaded onto the tubing hanger body 102, the torsion spring 114 is wound from a relaxed state to a torqued state. In this position, mechanical energy is stored in the torsion spring 114 which will generate a torque on the load nut 104 that will cause the load nut to rotate relative to the tubing hanger body 102. Due to the threaded connection between the load nut 104 and the body 102, this rotation will displace the load nut axially downward relative to the body and thereby increase the vertical distance between the load shoulder 106 and the locking dogs 108.

In order to maintain the torsion spring 114 in its torqued state, the tubing hanger 100 also includes means for preventing the load nut 104 from rotating relative to the tubing hanger body 102 until after the tubing hanger is landed in the wellhead 10. Referring to FIG. 4, for example, the tubing hanger and adjustable load nut assembly may include a latching mechanism 126 which is positioned in the tubing hanger body 102 and a de-latching mechanism 128 which is positioned in the load nut 104. In this example, the latching mechanism 126 comprises a latch member 130 which is slidably positioned in a bore 132 that is formed in a portion of the tubing hanger body 102 located proximate the upper surface of the load nut 104. The latch member 130 may be maintained in the bore 132 by a suitable gland nut 134 and may be biased toward the load nut 104 by a compression spring 136. The latch member 130 may also include an alignment pin 138 which extends vertically into a guide bore 140 that is formed in the tubing hanger body 102.

In this example, when the load nut 104 is in its initial position, a distal end 142 of the latch member 130 will be positioned in a corresponding groove 144 formed in the upper surface of the load nut. In this position, the spring 136 will bias the latch member 130 toward the load nut 104 with sufficient force to maintain the distal end 142 of the latch member fully engaged in the groove 144 and thus prevent the torsion spring 114 from rotating the load nut relative to the tubing hanger body 102.

In the illustrative embodiment shown in FIG. 4, the de-latching mechanism 128 functions to force the distal end 142 of the latch member 130 out of the groove 144 when the tubing hanger 100 lands in the wellhead 10. As shown in FIG. 4, the de-latching mechanism 128 may comprise an axially stiff but radially flexible rod 146 which is positioned in an axially extending through bore 148 formed in the load nut 104. The rod 146 includes a first end 146*a* which is located proximate the bottom of the groove 144 and a second end 146*b* which extends a distance below the load shoulder 106. In this manner, when the tubing hanger 100 lands in the wellhead 10, the seat 16 (not shown in FIG. 4) will contact the second end 146*b* and force the rod 146 axially upwardly, and the first end 146*a* will in turn force the distal end 142 of the latch member 130 out of the groove 144, thus permitting the load nut 104 to rotate relative to the tubing hanger body 102 as the torsion spring 114 unwinds.

During installation, the tubing hanger 100 is connected to a drill string and lowered from a surface vessel toward the wellhead 10. The tubing hanger 100 is lowered into the wellhead 10 until the load shoulder 106 on the adjustable load nut 104 lands on the seat 16 at the top of the casing hanger 14. As shown in FIG. 2, this action will force the rod 146 upward and displace the distal end 142 of the latch member 130 from the groove 144. In this position, the weight of the tubing hanger 100 and its depending tubing string (not shown) acting on the casing hanger 14 will prevent the torsion spring 114 from unwinding and rotating the load nut 104 relative to the tubing hanger body 102. The tubing hanger 100 is then locked to the wellhead by forcing the locking dogs 108 into the locking profile 32.

Figure 3:
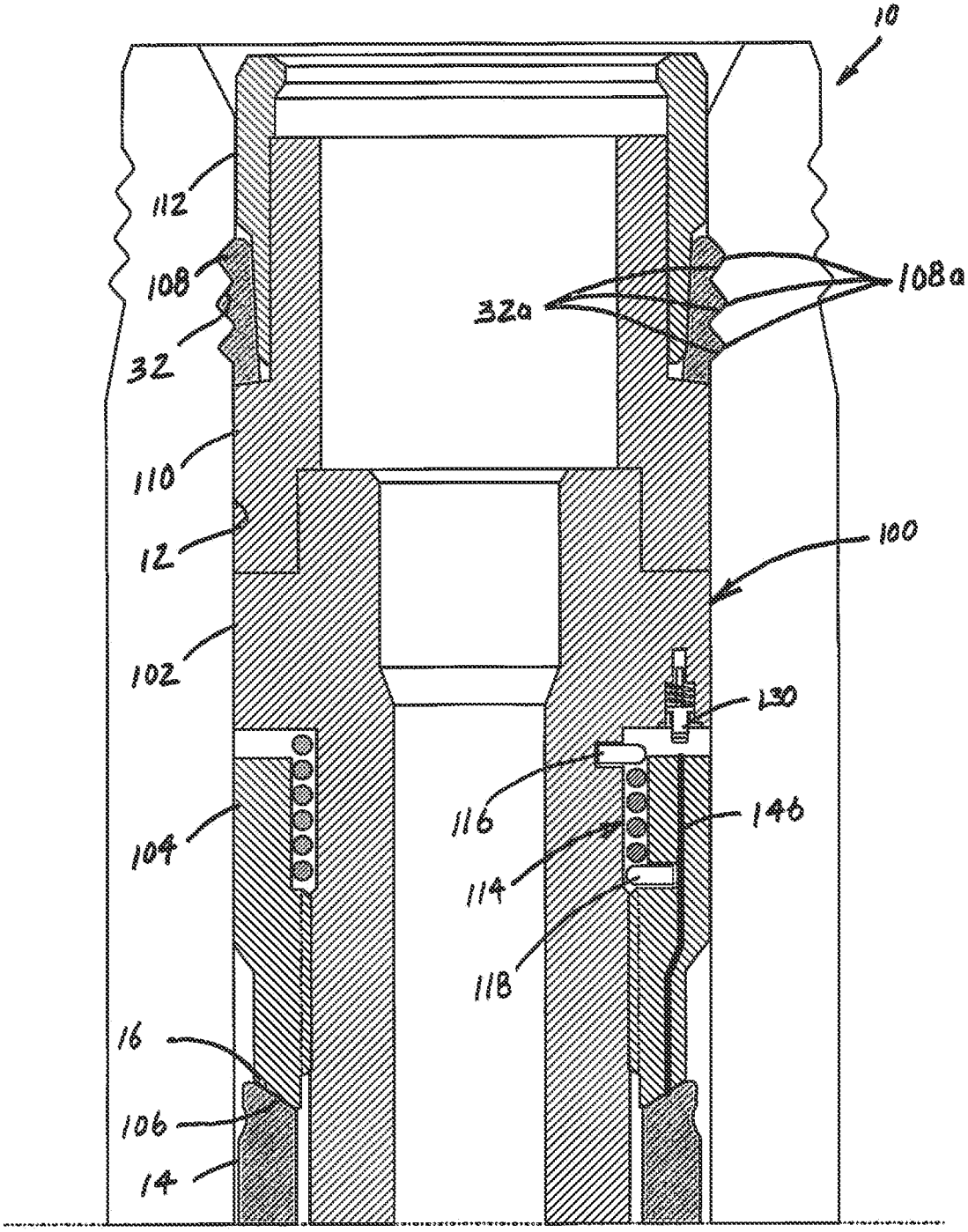
FIG. 3 is a cross sectional representation of the tubing hanger and adjustable load nut assembly of FIG. 2 shown immediately after the tubing hanger has been preloaded and the load nut has expanded into engagement with the landing seat.
Figure 6:
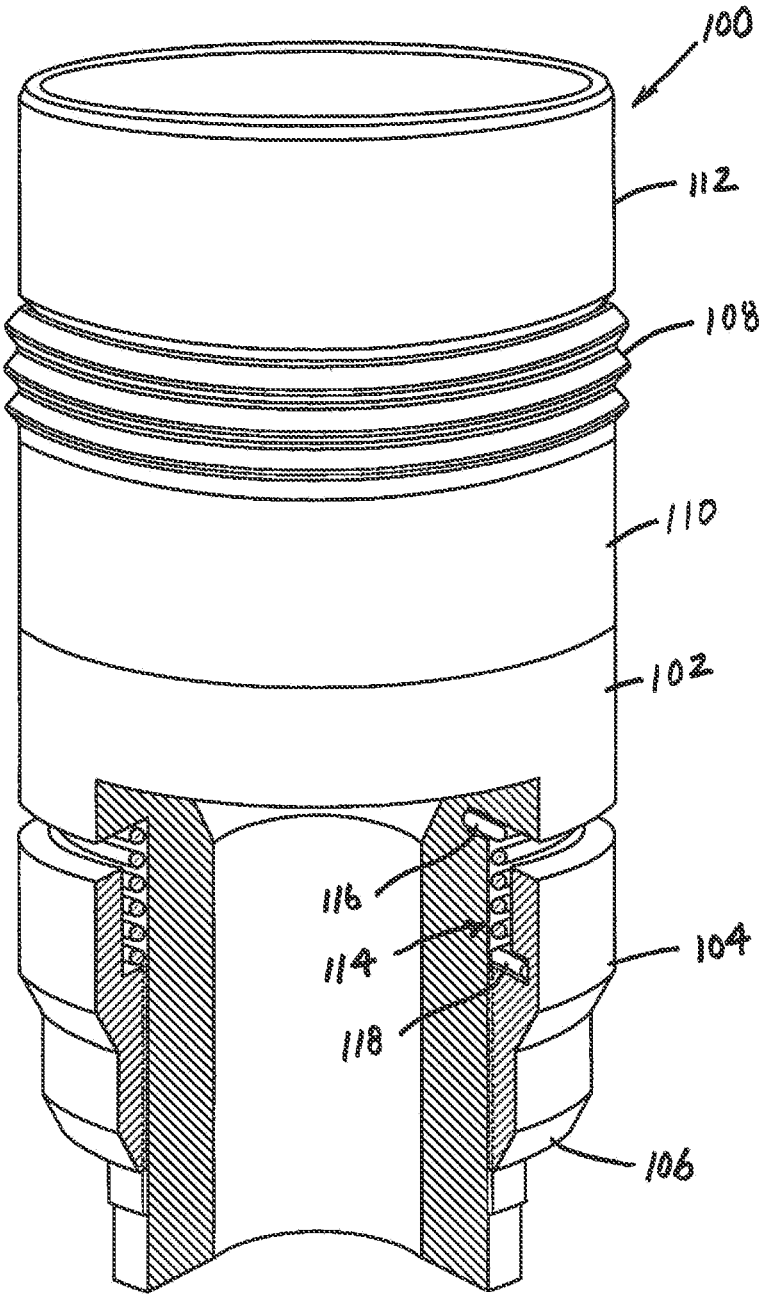
FIG. 6 is a perspective, partially cutaway view of the tubing hanger and adjustable load nut assembly of FIG. 5 showing the load nut in its final or lower position.

Once the tubing hanger 100 is locked to the wellhead 10, tension is applied to the drill string to lift the tubing hanger upward until the upper facing portions of the locking ridges 108*a* are fully loaded against the corresponding downward facing portions of the locking grooves 32*a*. During this process, the load nut 104 is lifted off of the landing seat 106. Since the latch member 130 is no longer engaged with the groove 144 in the top of the load nut 104, the torsion spring 114 will force the load nut to rotate downward relative to the tubing hanger body 102 until the landing shoulder 106 is once again fully engaged with the landing seat 106. This is the position of the load nut 104 shown in FIGS. 3 and 6. In this position, the locking dogs 108 will be fully preloaded with the locking grooves 32, thus minimizing possible fretting of the metal tubing hanger annulus seals (not shown) due to the development of thermal gradients during production startups and shutdowns.

In other embodiments, the latching and de-latching mechanisms may take different forms from those described above. For example, the latch member 130 may be mounted on the load nut 104 and be biased by a spring 136 or other suitable means into engagement with a corresponding groove formed in the tubing hanger body 102. In this example, the de-latching mechanism may comprise a rod or pin which is linked to the latch member 130 and which functions to retract the latch member from the groove when the rod or pin engages the seat 16 or a corresponding feature in the central bore 12 of the wellhead 10.

In another example, the latch member 130 shown in FIG. 4 may be sealed to the bore 132 in the manner of a piston. In this example, the de-latching mechanism may comprise a source of pressurized fluid which is located on, e.g., a surface vessel or a tubing hanger running tool which is used to install the tubing hanger 100. The source of pressurized fluid may be operationally connected to the latch member 130 via a conduit in the tubing hanger running tool which is connected to a corresponding conduit in the tubing hanger body 102 that in turn is connected to the bore 132 (or the alignment bore 140). In operation of this embodiment, once the tubing hanger 100 is landed on the seat 16, a negative pressure from the source of pressurized fluid is applied to the bore 132 to retract the latch member 130 from the groove 144.

In a variation of this embodiment, the spring 136 may be removed and the source of pressurized fluid may be used to both extend the latch member 130 into the groove 144 (by applying a positive pressure to the bore 132) and retract the latch member from the groove 144 (by applying a negative pressure to the bore 132).

In a further variation, the spring 136 may comprise an extension spring which functions to retract the latch member 130 from the groove 144. In this example, the source of pressurized fluid may be used to maintain the latch member in the groove until the tubing hanger 100 is landed on the seat 16, at which point the pressure can be released to allow the latch member 130 to retract from the groove.

In a further embodiment, the latching and de-latching mechanisms may comprise a number of shear pins or the like which are connected between the load nut 104 and the tubing hanger body 102.

Although the torsion spring arrangement has been described herein in the context of a tubing hanger which is landed on a casing hanger supported in a wellhead, it should be understood that it could be used in other applications, either within or outside of the field of subsea hydrocarbon production systems. In the field of subsea hydrocarbon production systems, for example, the torsion spring arrangement could be used to obtain proper spacing between any tubular hanger and any component within which the tubular hanger is landed, such as, e.g., a tubing spool or tubing head.

More generally, the present disclosure provides a torsion spring arrangement for use in securing an inner member to an outer member which surrounds at least a portion of the inner member. In one embodiment, the outer member comprises first and second axially spaced outer features and the inner member comprises first and second axially spaced inner features which are configured to engage the outer features to secure the inner member to the outer member. The first inner feature is formed on a component which is threadedly connected to the inner member, and the torsion spring arrangement is operable to rotate the component to thereby move the first inner feature axially relative to the inner member until the first and second inner features engage the first and second outer features, respectively, to secure the inner member to the outer member. Alternatively, the first outer feature may be formed on a component which is threadedly connected to the outer member, and the torsion spring arrangement may be operable to rotate the component to thereby move the first outer feature axially relative to the outer member until the first and second inner features engage the first and second outer features, respectively, to secure the inner member to the outer member.

It should be recognized that, while the present disclosure has been presented with reference to certain embodiments, those skilled in the art may develop a wide variation of structural and operational details without departing from the principles of the disclosure. For example, the various elements shown in the different embodiments may be combined in a manner not illustrated above. Therefore, the following claims are to be construed to cover all equivalents falling within the true scope and spirit of the disclosure.

What is claimed is:

1. A tubing hanger assembly comprising:

a tubing hanger body;

a downward facing load shoulder which is axially displaceable relative to the body;

an annular load member which is rotatably supported on the body;

wherein rotation of the load member relative to the body results in axial displacement of the load shoulder relative to the body;

a torque member which is operatively engaged between the load member and the body;

wherein in use of the tubing hanger assembly, the torque member rotates the load member to thereby displace the load shoulder axially relative to the body.

2. The tubing hanger assembly of claim 1, wherein the load shoulder is located on the load member.

3. The tubing hanger assembly of claim 2, wherein the load member is threadedly connected to the body such that rotation of the load member relative to the body results in axial displacement of the load shoulder relative to the body.

4. The tubing hanger assembly of claim 1, wherein the load member comprises a first annular contact surface configured to engage a second annular contact surface which is rotationally fixed relative to the body, and wherein the first and second contact surfaces are configured such that rotation of the first contact surface relative to the second contact surface results in axial displacement of the load shoulder relative to the body.

5. The tubing hanger assembly of claim 4, wherein the first and second contact surfaces are configured as opposing first and second ramp surfaces, respectively.

6. The tubing hanger assembly of claim 5 wherein the first and second ramp surfaces are defined by complimentary first and second screw threads formed on an inner diameter surface of the load member and an outer diameter surface of the body, respectively.

7. The tubing hanger assembly of claim 1, wherein the torque member comprises a spring member.

8. The tubing hanger assembly of claim 1, wherein the torque member comprises a torsion spring having a first end connected to the load member and a second end connected to the body.

9. The tubing hanger assembly of claim 1, further comprising a latch member which is mounted on one of the body and the load member, the latch member being releasably engageable with the other of the body and the load member to thereby selectively prevent the load member from rotating relative to the body.

10. The tubing hanger assembly of claim 9, wherein the latch member is biased into engagement with a corresponding groove formed on said other of the body and the load member.

11. The tubing hanger assembly of claim 10, further comprising:

a de-latching rod which extends axially through said one of the body and the load member, the de-latching rod having a first end located proximate a bottom of the groove;

wherein application of an axial force to a second end of the de-latching rod causes the first end to displace the latch member from the groove.

12. A tubing hanger assembly comprising:

a tubing hanger body;

a downward facing load shoulder which is axially displaceable relative to the body;

an annular load member which is rotatably supported on the body;

wherein rotation of the load member relative to the body results in axial displacement of the load shoulder relative to the body;

a latch member which is mounted on one of the body and the load member, the latch member being releasably engageable with the other of the body and the load member to thereby selectively prevent the load member from rotating relative to the body.

13. The tubing hanger assembly of claim 12, wherein the latch member is biased into engagement with a corresponding groove formed on said other of the body and the load member.

14. The tubing hanger assembly of claim 13, further comprising:

a de-latching rod which extends axially through said one of the body and the load member, the de-latching rod having a first end located proximate a bottom of the groove;

wherein application of an axial force to a second end of the de-latching rod causes the first end to displace the latch member from the groove.

15. The tubing hanger assembly of claim 12, further comprising:

a torque member which is operatively engaged between the load member and the body;

wherein in use of the tubing hanger assembly, the torque member rotates the load member to thereby displace the load shoulder axially relative to the body.

16. The tubing hanger assembly of claim 15, wherein the torque member comprises a spring member.

17. The tubing hanger assembly of claim 15, wherein the torque member comprises a torsion spring having a first end connected to the load member and a second end connected to the body.

18. The tubing hanger assembly of claim 12, wherein the load shoulder is located on the load member.

19. The tubing hanger assembly of claim 18, wherein the load member is threadedly connected to the body such that rotation of the load member relative to the body results in axial displacement of the load shoulder relative to the body.

20. The tubing hanger assembly of claim 12, wherein the load member comprises a first annular contact surface configured to engage a second annular contact surface which is rotationally fixed relative to the body, and wherein the first and second contact surfaces are configured such that rotation of the first contact surface relative to the second contact surface results in axial displacement of the load shoulder relative to the body.

21. The tubing hanger assembly of claim 20, wherein the first and second contact surfaces are configured as opposing first and second ramp surfaces, respectively.

22. The tubing hanger assembly of claim 21 wherein the first and second ramp surfaces are defined by complimentary first and second screw threads formed on an inner diameter surface of the load member and an outer diameter surface of the body, respectively.

23. A method of installing a tubing hanger assembly in a wellhead, the wellhead comprising a first tubing hanger lockdown feature and a central bore in which a casing hanger is positioned, and the tubing hanger assembly comprising a second tubing hanger lockdown feature configured to engage the first tubing hanger lockdown feature, a tubing hanger body, a downward facing load shoulder axially displaceable relative to the body, and an annular load member rotatably supported on the body, wherein rotation of the load member relative to the body results in axial displacement of the load shoulder relative to the body, the method comprising:

lowering the tubing hanger assembly into the wellhead;

engaging the second tubing hanger lockdown feature with the first tubing hanger lockdown feature to thereby secure the tubing hanger assembly in the wellhead;

rotating the load member until the load shoulder engages the casing hanger.

24. The method of claim 23, wherein the step of rotating the load member is performed by releasing a spring member which is operatively engaged between the body and the load member.

25. The method of claim 24, wherein the spring member comprises a torsion spring having a first end connected to the load member and a second end connected to the body.

26. The method of claim 23, wherein the load shoulder is located on the load member.

27. The method of claim 26, wherein the load member is threadedly connected to the body such that rotation of the load member relative to the body results in axial displacement of the load shoulder relative to the body.

28. The method of claim 23, wherein the load member comprises a first annular contact surface configured to engage a second annular contact surface which is rotationally fixed relative to the body, and wherein the first and second contact surfaces are configured such that rotation of the first contact surface relative to the second contact surface results in axial displacement of the load shoulder relative to the body.

29. The method of claim 28, wherein the first and second contact surfaces are configured as opposing first and second ramp surfaces, respectively.

30. The method of claim 29 wherein the first and second ramp surfaces are defined by complimentary first and second screw threads formed on an inner diameter surface of the load member and an outer diameter surface of the body, respectively.

* * * * *